United States Patent [19]

Rogers

[11] Patent Number: 4,925,075

[45] Date of Patent: May 15, 1990

[54] HANDGUN HOLSTER WITH TRIGGER GUARD RESTRAINT

[75] Inventor: William H. Rogers, Jacksonville, Fla.

[73] Assignee: Safariland Ltd., Inc., Monrovia, Calif.

[21] Appl. No.: 318,125

[22] Filed: Mar. 2, 1989

[51] Int. Cl.[5] ..... F41C 33/02

[52] U.S. Cl. ..... 224/244; 224/192; 224/193; 224/238; 224/911; 224/912

[58] Field of Search ..... 224/911, 912, 192, 193, 224/196, 198, 238, 243, 244, 253

[56] References Cited

U.S. PATENT DOCUMENTS

| | | | |
|---|---|---|---|
| 1,113,530 | 10/1914 | Audley | 224/244 |
| 1,641,439 | 9/1927 | Jovino | 224/911 X |
| 2,349,376 | 5/1944 | Ray | 224/244 |
| 2,551,913 | 5/1951 | Toby | 224/244 |
| 3,669,325 | 6/1972 | Furman | 224/243 |
| 3,977,583 | 8/1976 | Bianchi et al. | 224/243 |
| 4,101,060 | 7/1978 | Bianchi et al. | 224/243 |
| 4,256,243 | 3/1981 | Bianchi et al. | 224/244 |
| 4,277,007 | 7/1981 | Bianchi et al. | 224/193 |
| 4,286,741 | 9/1981 | Rogers | 224/193 |
| 4,318,503 | 3/1982 | Capano | 224/244 |

*Primary Examiner*—Ernest G. Cusick
*Attorney, Agent, or Firm*—Arthur G. Yeager

[57] ABSTRACT

Handgun holster having a restraining device inside the holster for retaining the handgun in the holster and inhibiting inadvertent removal from the holster, the restraining device employing a spring biased catch for engaging the trigger guard with a selectively adjustable member to provide increased or decreased restraining force on the trigger guard.

19 Claims, 5 Drawing Sheets

HANDGUN HOLSTER WITH TRIGGER GUARD RESTRAINT

BACKGROUND OF THE INVENTION

This invention relates to a handgun holster with an adjustable restraint device for retaining the handgun in the holster and preventing it from removal not intended by the wearer.

Law enforcement officers, and particularly competitive shooters who have a need to carry a handgun normally do so in a holster, and it is important that the holster permit a "quick draw", and yet be secure in the holster against falling out when the wearer is running or otherwise involved in activity, and against the possibility of withdrawal by someone other than the wearer. Various arrangements have been used such as, cover flaps, restraining straps, spring mechanisms, custom molding of the holster to fit each gun, and the like. Typical of such arrangements are those shown in my U.S. Pat. No. 4,694,980 and in U.S. Pat. No. 4,101,060 to Bianchi. The present invention is an improvement over these prior art holsters.

It is an object of the present invention to provide an improved handgun holster. It is another object of this invention to provide an improved holster having a novel means for restraining the handgun from being withdrawn from the holster until the wearer intends to do so. Still other objects will become apparent from the more detailed description which follows.

BRIEF SUMMARY OF THE INVENTION

This invention relates to an improved handgun holster which is designed to permit withdrawal from the holster only when the initial movement of the handgun is vertically upward, the holster having a restraining device attached to the inside of said back of said holster adjacent said top, said device being an elongated channel member having two side walls generally parallel to each other and attached to a back wall and spaced apart from each other leaving an open front slot. A boss projects outwardly from one of the walls of the device and terminates spacedly from the other wall of the device and the walls of the device are sufficiently resilient to permit the open front slot to be sprung open manually sufficiently to admit the trigger guard of the handgun to slide over the boss and close so as to restrain the handgun in the device in the holster. An adjustment screw is connected to both of the walls of the device for increasing or decreasing the resistance of the walls, against the sides of the trigger guard, to be spring open.

In more specific and preferred embodiments of the invention the holster has an open front to facilitate a quick draw; a rotatable tubing concentrically around the adjusting screw to function as a stop means to prevent the handgun from moving downward in the holster beyond its secured position with the boss fitting snugly against the inside of the trigger guard; and sloping sides on the boss to facilitate release of the handgun as it is withdrawn from the holster.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the follow description taken in connection with the accompanying drawings in which:

DETAILED DESCRIPTION OF THE INVENTION

Figure 1:
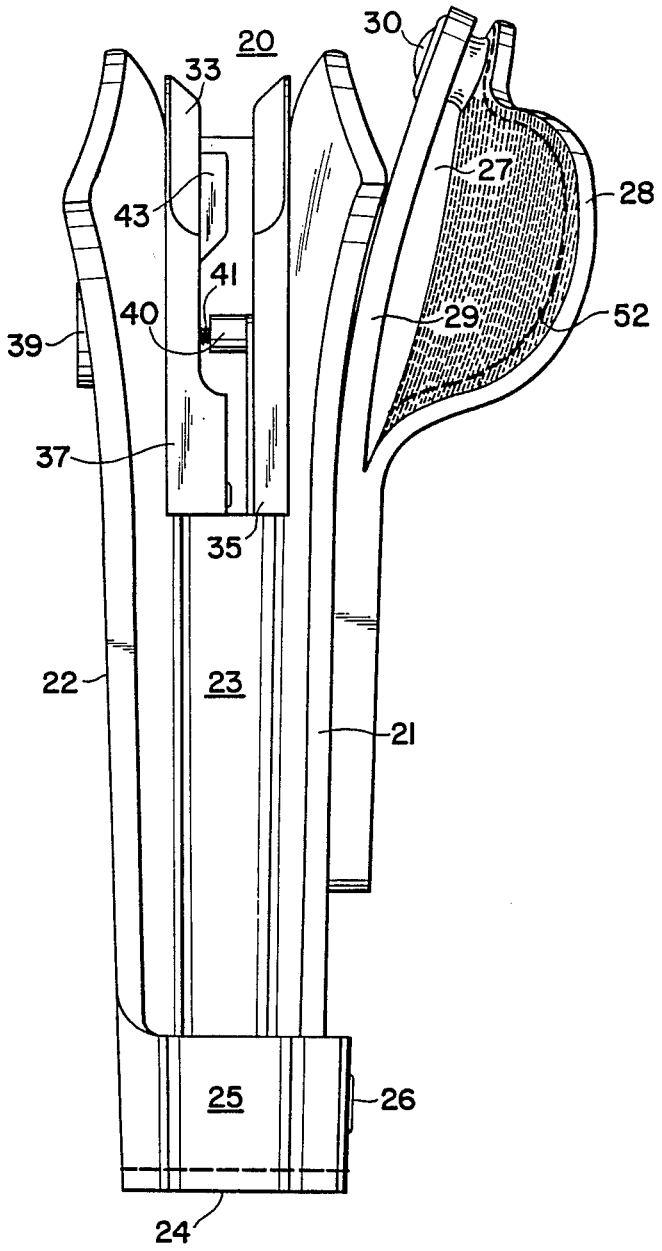
FIG. 1 is a front elevational view of the holster of this invention.
Figure 2:
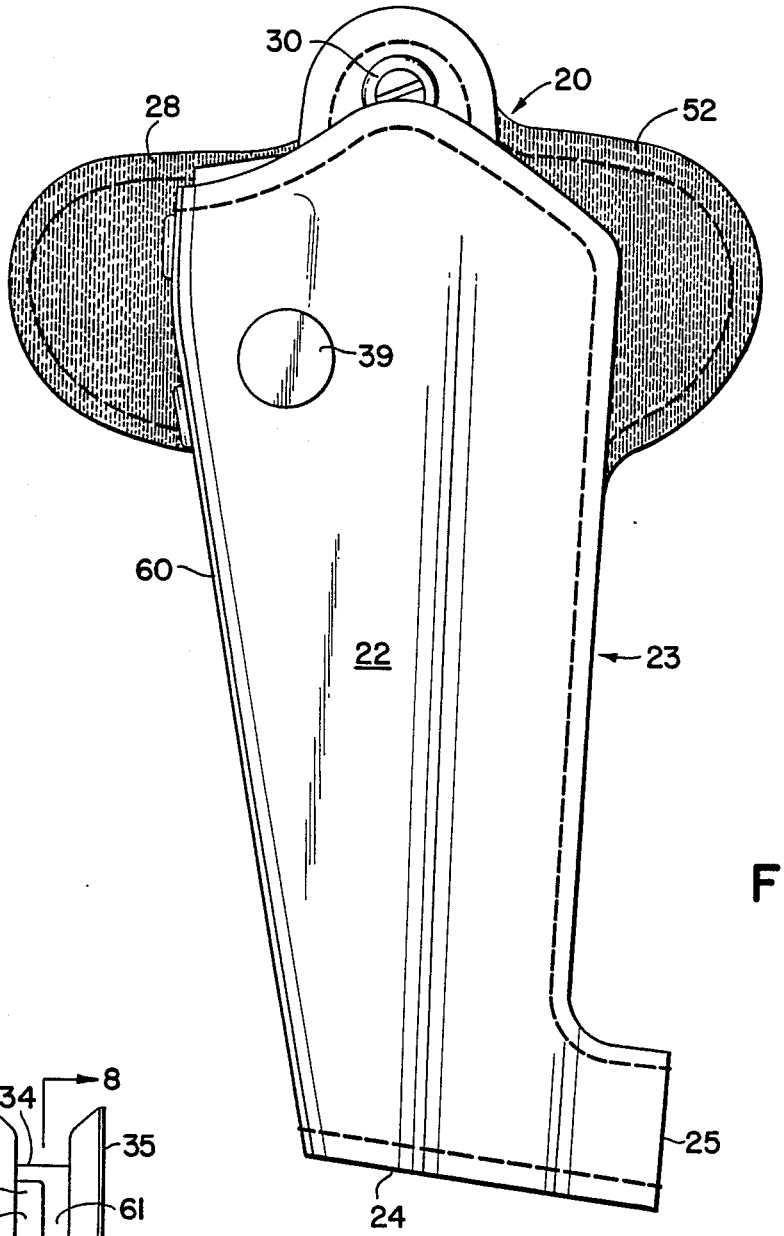
FIG. 2 is a left side elevational view of the holster of this invention.

The various features of this invention are best understood from the following description with reference to the accompanying drawings.

The holster, as seen in FIGS. 1–4, comprises an inner wall 21 and an outer wall 22, an open top 20, a bottom 24, enclosing a space in which a handgun is carried. These components as well as others in the following disclosure, are intended to describe directions and relative locations with respect to the wearer of the holster. Thus, inner wall 21 is closer to the body of the wearer than outer wall 22, and top 20 is vertically above bottom 24. A belt loop 27 is formed by an inside hip pad 28 and an outside member 29 riveted together by rivets 32 at the lower end of the loop and joined together at the upper end by a screw fastener 30 and nut 51. The waist belt of the wearer can be threaded through loop 27. In a preferred embodiment the side 52 of hip pad 28 is roughened or covered with a material such as the fabric hooks of a Velcro fastener to provide additional friction to hold the holster in the desired position on the waist belt and at the position on the hip desired by the wearer. The inside of the hip pad resting against the wearer is smooth and preferably molded to fit the wearer's contours.

The holster shown here is a front opening holster, which means that the handgun is withdrawn from the holster through a slotted front opening 23 extending from open top 20 to the bottom 24 of the holster. This particular design fastens the lower front corners of walls 21 and 22 to each other by a strap 25 integral with one side wall (22 here) and fastened to the other wall (21 here) with a screw fastener 26 or its equivalent.

The principal improvement of this invention which is believed to be novel and inventive is the restraining device 33 which is fastened inside the holster along its back or spine 60 adjacent the open top 20. A preferred method of fastening the device 33 to the holster back 60 is by screws 67 passing through holster back 60 and engaged in internally threaded holes 56. Other fastening methods, e.g., riveting or cementing, are entirely suitable for some purposes. Device 33 is in the shape of an elongated U-channel having an inner wall 35 parallel to an outer wall 37 extending outwardly from a back wall 34 to leave an open front 36 extending lengthwise of device 33. On the inner side of one side wall (outer wall 37 shown here) a strip spring 64 attached to the bottom of the side wall with a rivet 57 and otherwise free of the side wall at the top of strip spring 64 is a boss 43 extending outwardly from strip spring 64 which is biased toward the other side wall (inner wall 35 here) so as to leave a space 61 between said boss 43 and said inner wall 35. Boss 43 is sized and positioned such that it will, when the handgun is secured in the holster, be inside of the trigger guard and will prevent the trigger guard from sliding over the boss and releasing the gun from the holster without the wearer applying an appropriate manual force to cause that to happen. Extending laterally across open front 36 is an adjustment screw 38 having an enlarged head 39 for manipulation by the thumb of the wearer and having a screw thread shank 41 extending across open front 36 and engaged in an internally threaded hole or nut 42 in inner wall 35. By turning head 39 the wearer can cause the side walls 35 and 37 to be closer together or farther apart thereby increasing or decreasing the bias of strip spring 64 which is roughly equivalent to the force necessary to remove the handgun from the restraining device in the holster. Around adjustment screw 38 between walls 35 and 37 is a short piece of tubing 40 free to rotate around screw shank 41, which serves as a stop that bears against the outside of trigger guard 54 and holds the handgun in place preventing the trigger of the gun from touching boss 43.

Figure 6:
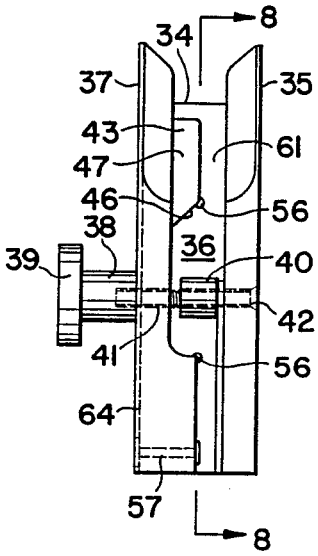
FIG. 6 is a front elevational view of the handgun restraining device employed in the holsters of FIGS. 1–5.
Figure 7:
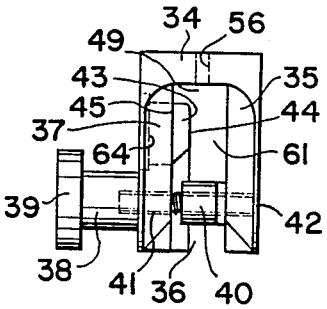
FIG. 7 is a top plan view of the restraining device of FIG. 6.
Figure 5:
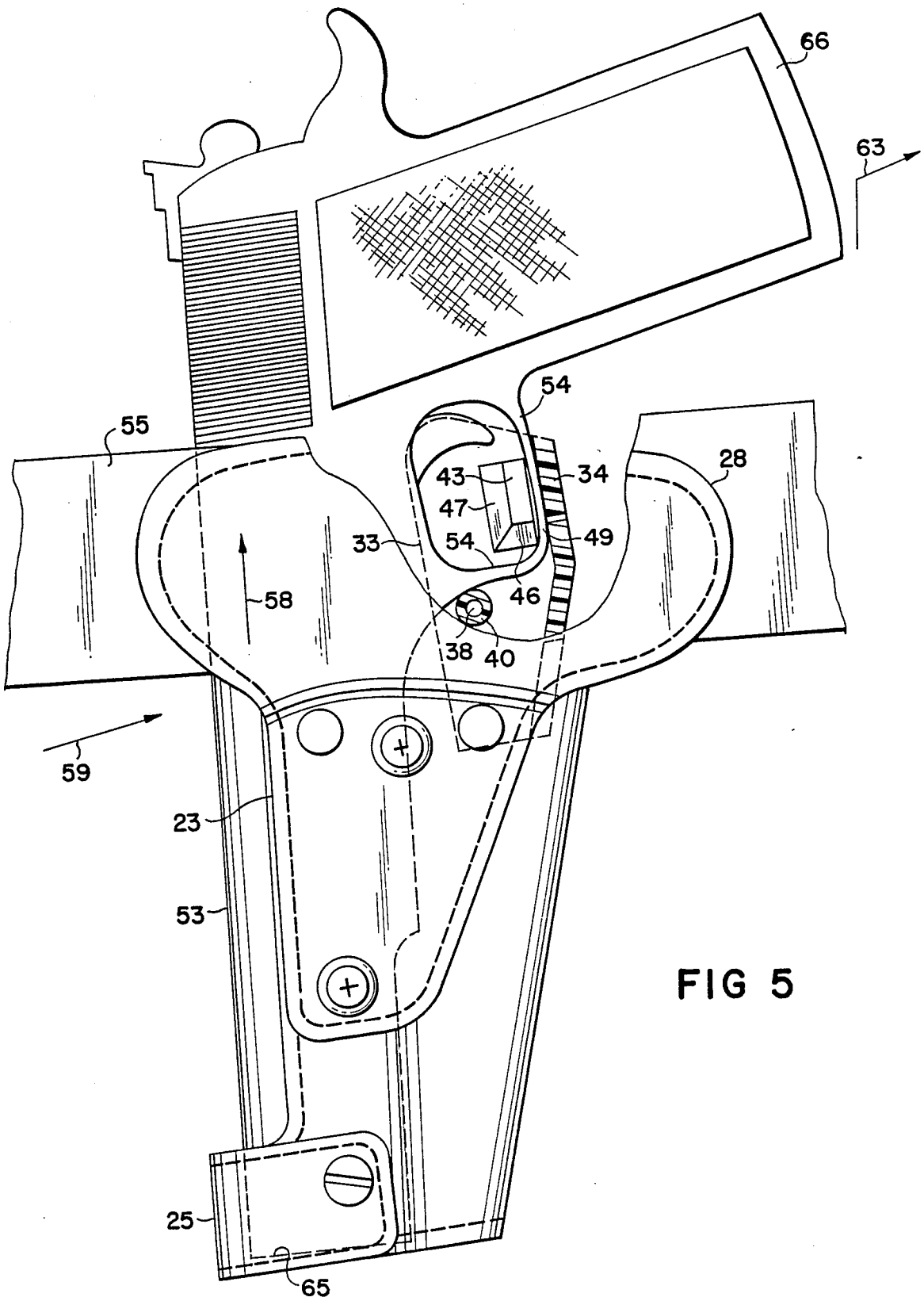
FIG. 5 is a side elevational view of the holster of this invention, partly broken away with a semi-automatic pistol in the holster in the secure position.
Figure 3:
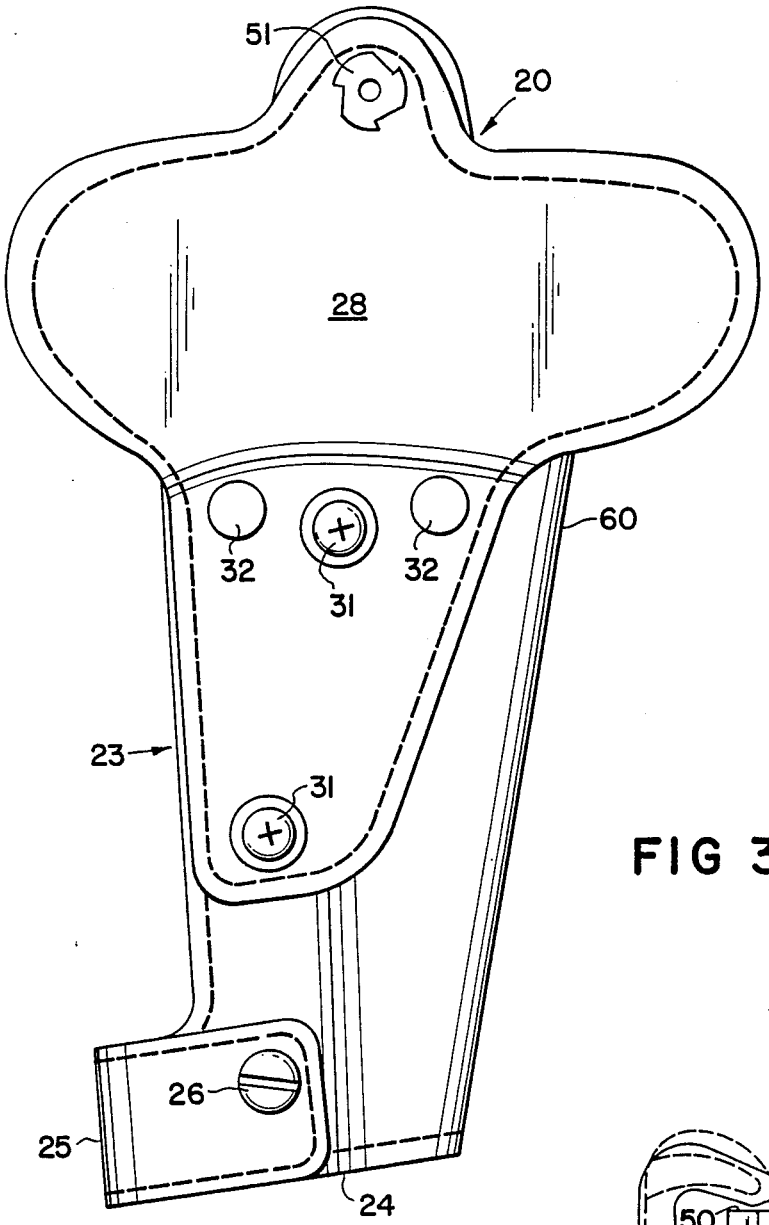
FIG. 3 is a right side elevational view of the holster of this invention.
Figure 10:
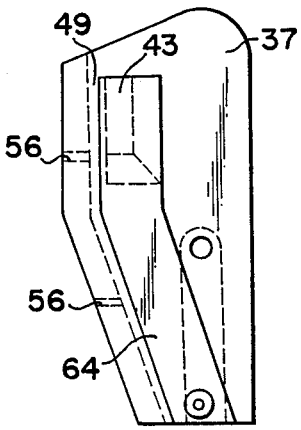
FIG. 10 is a side elevational view of the restraining device with the adjusting screw removed to show the leaf spring means.
Figure 11:
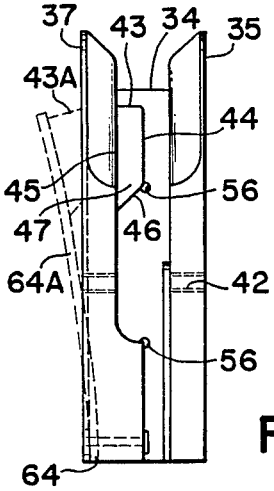
FIG. 11 is a front elevational view similar to FIG. 6 but with the adjusting screw removed and showing the operation of the leaf spring means.
Figure 8:
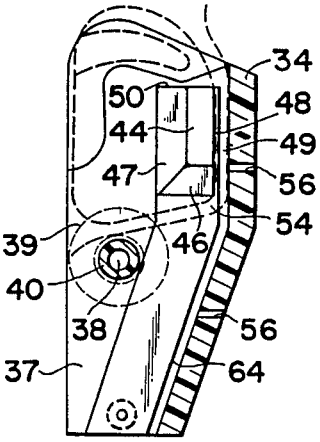
FIG. 8 is a cross sectional view taken at 8—8 of FIG. 6.
Figure 4:
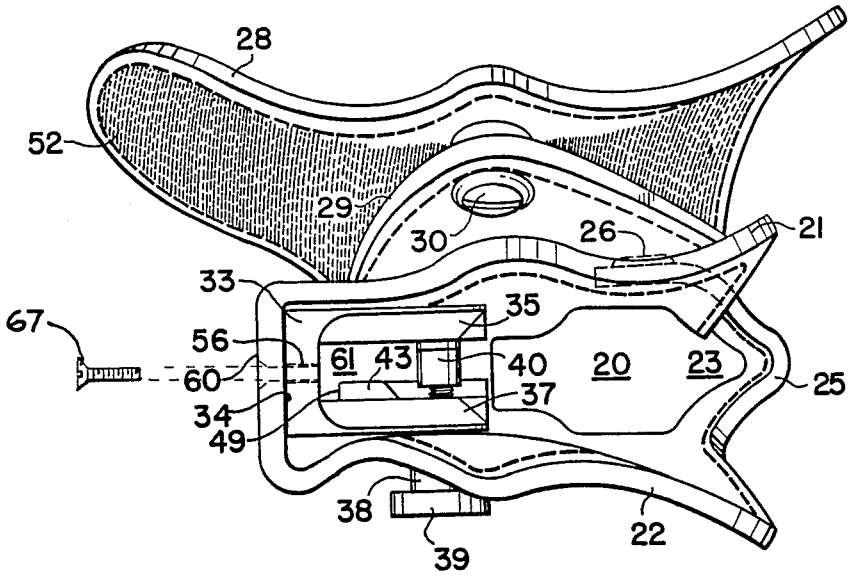
FIG. 4 is a top plan view of the holster of this invention.
Figure 9:
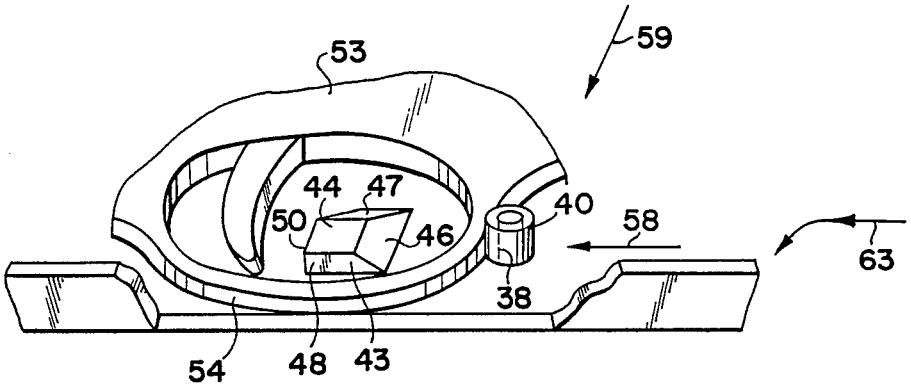
FIG. 9 is a schematic view in perspective of the boss inside the trigger guard restraining the handgun in the holster.

As seen more easily in FIGS. 6–8, boss 43 preferably is in the shape of a truncated four-sided pyramid with a smaller top surface 44 generally parallel to a larger bottom surface 45 (not visible in any of the attached drawings). Two adjoining side walls 46 and 47 slope outwardly from top surface 44 to bottom surface 45. The other two side walls 48 and 50 are generally perpendicular to each other and to both top surface 44 and bottom surface 45. Boss 43 is shown as positioned with bottom surface 45 attached to the inside of strip 64 functioning as a leaf spring and attached at its bottom by rivet 57 to outer wall 37. Top surface 44 is spaced away from the inside of inner wall 35 and is biased toward inner wall 35 by strip spring 64. Boss 43 is also oriented such that one sloping wall 46 faces bottom 24 of the holster and the adjoining sloping wall 47 generally faces toward open front 23 of the holster. The orientation of sloping walls 46 and 47 is to facilitate the movement of the trigger guard 54 of the handgun 53 into and out of the holster restraining device 33. When placing the handgun 53 in the holster the muzzle of the handgun is placed inside strap 25 and the gun moved in the direction of arrow 59 in FIG. 5. Trigger guard 54 contacts sloping surface 47 of boss 43 moving up and over the top surface 44, causing strip 64 and boss 43 to flex outwardly to the positions of 64A and 43A, respectively, as shown in FIG. 11, and then to return to the original unflexed positions of 64 and 43. Trigger guard thereby falls into space 49 between rear wall 48 of boss 43 and back wall 34 of restraining device 33. When the handgun 53 is withdrawn from the holster :t must be moved vertically upward as in the direction of arrow 58 in FIG. 5 in order to clear boss 43. This is accomplished by the trigger guard 53 sliding up sloping surface 46 to clear the top surface 44 of boss 43 and then the handgun 53 can be rotated forward out of front opening 23. Fist the butt or hand grip 66 of the gun 53 is moved upward to permit the trigger guard 54 to clear strap 25. Then the butt 66 of gun 53 is moved rearwardly rotating gun 53 around trigger guard 54 to bring muzzle 65 forward into firing position. These movements constitute a "fast draw" from the holster and may only require about a one-half to one inch draw to clear strap 25 before the gun can be brought into firing position.

It should be noted that while this description and its attached drawings refer to an open front holster, the restraining device 33 can clearly be employed with other types of holsters that are not open front designs. The holster is preferably made of a molded plastic material as described and claimed in my U.S. Pat. No. 4,340,437 which issued July 20, 1982. Restraining device 33 is preferably molded from plastic. The leaf spring means 64 may be a strip of plastic, the same as or different from that of the rest of restraining device 33, or it may be of other material. The rigidity of the strip spring 64 may be adjusted in manufacturing by adding "glass" to the plastic, as is well known in the art, and should hold about a one and one-half pound gun therein, i.e., the draw should be at least two to three pounds to cause the trigger guard to be released by action of spring finger means 64 and boss 43.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a handgun holster adapted to permit withdrawal of a handgun having a trigger guard from the holster by a vertical upward movement of the handgun, said holster having with respect to the wearer an inner wall, an outer wall, a front, a back, a top, a bottom, an inside, an outside, and a loop for suspending said holster from a belt worn by the wearer, the improvement which comprises a handgun restraining device attached to the inside of said back of said holster adjacent said top, said device being an elongated channel member having a back wall and two generally parallel side walls attached to said back wall and spaced apart from each other so as to leave an open front slot, a leaf spring means in one of said side walls, a boss projecting outwardly from said leaf spring means; said boss terminating spacedly from the other said side wall, said leaf spring means being biased to urge said boss toward said other side wall and being sufficiently resilient that the movement of pushing said handgun into said holster will overcome said bias and cause said boss to be moved away from said other side wall to admit said trigger guard of said handgun to slide over said boss and when said handgun is fully holstered said bias will cause said boss to return to its original position spaced from said other side wall but inside said trigger guard.

2. The holster of claim 1 which additionally comprises an adjustment screw connected to both said side walls of said device for increasing or decreasing said bias.

3. The holster of claim 2 wherein said device includes a stop means to bear against the outside of said trigger guard when said handgun is placed in said holster.

4. The holster of claim 3 wherein said stop means comprises a hollow tubular member loosely fitting around said adjustment screw between said side walls of said device.

5. The holster of claim 1 which additionally comprises an open front extending from said top to adjacent said bottom.

6. The holster of claim 5 wherein said inner wall and said outer wall are joined by a strap across said open front at said bottom.

7. The holster of claim 1 wherein said spring means comprises a thin strip of material with said boss attached to said strip at one end thereof and the other end of said strip being fixedly attached to said one of said side walls.

8. The holster of claim 1 wherein said device is affixed to said holster by screw means passing through the back of said holster and engaged with internally threaded holes in said back wall of said device.

9. The holster of claim 1 wherein said boss has the shape of a truncated pyramid having a smaller top surface and a larger bottom surface generally parallel with each other and joined together by two contiguous sloping sides and two contiguous upright sides that are perpendicular to each other and to both said top surface and said bottom surface, said bottom surface being affixed to said one of said side walls and said top surface being spaced apart from said other said side wall.

10. The holster of claim 9 wherein said boss is positioned with one of said upright sides spaced away from said back wall of said device sufficiently to permit one said upright side to be inside said trigger guard while said back wall is outside said trigger guard.

11. The holster of claim 10 wherein said two contiguous sloping sides face respectively toward said bottom of said holster and away from said back of said holster.

12. A restraining clip for attachment to the inside of a holster for a handgun having a trigger guard; said clip being adapted to permit said trigger guard to be snapped thereinto and to restrain said handgun from being inadvertently withdrawn from said holster, said clip being an elongated U-shaped channel having a back wall and two upright generally parallel side walls each attached at one of its longitudinal edges to said back wall generally perpendicular to said side walls with the others of said longitudinal edges defining an open slot lengthwise of said clip, a thin resilient strip spring attached at one end thereof to one of said side walls and a boss projecting outwardly from the other end of said strip spring toward the other said side wall and terminating spacedly from said other side wall, said strip spring being biased to urge said boss toward said other said side wall, said boss being so shaped and positioned that when it is inside said trigger guard of the handgun fully inserted into said holster, said handgun will be restrained from inadvertent removal from said holster, and yet when said strip spring is flexed outwardly said handgun can be easily withdrawn from said holster; and a manually adjustable screw means connecting both of said side walls to provide for increasing or decreasing said bias.

13. The clip of claim 12 which additionally comprises a stop means to cooperate with said boss and to be positioned outside said trigger guard and to hold said trigger guard in close proximity to said boss.

14. The clip of claim 13 wherein said stop means comprises a freely rotatable tubular member positioned around said screw means and located between said side walls.

15. The clip of claim 14 in which said channel and said strip spring are made of a plastic material having sufficient stiffness and resiliency to provide the necessary springiness to permit said strip spring to flex outwardly and return to its unflexed position.

16. A front opening holster for a handgun having a trigger guard, said holster including a top, a bottom, a front, a back, two sides, an inside, and an outside; said two sides being joined together at said back and spaced apart from each other at said front to define a vertical slot opening at said front and said top; a strap across said front adjacent said bottom attached to both said sides, and a belt loop adjacent said top of one of said sides; said holster including a handgun restraining device affixed to said inside adjacent said top of said back, said device having two substantially parallel spaced side walls extending respectively, along said sides of said holster and a back affixed to said back of said holster, a leaf spring means attached to one of said side walls and a boss projecting outwardly from said spring means, biased toward but spaced apart from the other of said side walls, said leaf spring means being sufficiently flexible and resilient to permit said trigger guard to be pushed over said boss as said handgun is inserted into said holster and to return to its unflexed position with said boss inside the perimeter of said trigger guard when said handgun is fully inserted into said holster.

17. The holster of claim 16 which additionally comprises screw means to adjust said bias of said leaf spring means.

18. The holster of claim 17 which additionally comprises screw means for affixing said device to said holster back between said two sides.

19. The holster of claim 17 wherein said boss has the shape of a truncated pyramid with a smaller top surface parallel to a larger bottom surface and connected to each other by two adjoining sloping sides and two adjoining upright sides perpendicular to each other and perpendicular to both said top and bottom surfaces, said boss being positioned so as to fit inside the trigger guard of said handgun and to keep said trigger guard snugly against said back of said device; said sloping sides respectively facing said bottom of said holster and said vertical slot opening.

* * * * *